US006752296B1

(12) United States Patent
Sweeton et al.

(10) Patent No.: US 6,752,296 B1
(45) Date of Patent: Jun. 22, 2004

(54) BI-INJECTION TRIGGER SPRAYER NOZZLE CAP

(75) Inventors: Steve L. Sweeton, Lee's Summit, MO (US); Phillip J. DiMaggio, Kansas City, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 10/383,685

(22) Filed: Mar. 10, 2003

(51) Int. Cl.[7] ..... B05B 9/043

(52) U.S. Cl. ..... 222/383.1; 222/380; 222/548; 222/566; 239/333; 239/437; 239/451

(58) Field of Search ..... 222/372, 380, 222/383.1, 526, 537, 544, 548, 566; 239/333, 436, 437, 451

(56) References Cited

U.S. PATENT DOCUMENTS 5,040,701 A * 8/1991 Knickerbocker et al. ..... 222/153.07
5,040,702 A * 8/1991 Knickerbocker et al. ..... 222/153.07
5,088,628 A * 2/1992 Knickerbocker ..... 222/153.14
5,169,032 A * 12/1992 Steijns et al. ..... 222/153.07
5,228,600 A * 7/1993 Steijns et al. ..... 222/153.14
5,439,124 A 8/1995 Mock ..... 215/40
5,642,860 A 7/1997 Bush et al. ..... 239/333
5,706,984 A * 1/1998 Tada et al. ..... 222/182
5,975,381 A 11/1999 Revenu ..... 222/563
6,029,866 A 2/2000 Wood et al. ..... 222/536
6,073,815 A 6/2000 Ponton ..... 222/402
6,120,481 A 9/2000 Rennert et al. ..... 604/187
6,126,090 A 10/2000 Wadsworth et al. ..... 239/333
6,186,366 B1 * 2/2001 Good et al. ..... 222/153.14
6,234,365 B1 5/2001 Bougamont et al. ..... 222/494
6,286,728 B1 * 9/2001 Driskell et al. ..... 222/383.1
6,382,527 B1 * 5/2002 Dukes et al. ..... 239/333
6,401,990 B1 6/2002 Walters et al. ..... 222/547
6,446,882 B1 * 9/2002 Dukes et al. ..... 239/333
2001/0054626 A1 12/2001 Bethune et al. ..... 222/340
2002/0060255 A1 5/2002 Benoist ..... 239/337
2002/0079334 A1 6/2002 Schantz et al. ..... 222/213

* cited by examiner

*Primary Examiner*—J. Casimer Jacyna
(74) *Attorney, Agent, or Firm*—Dykema Gossett PLLC

(57) ABSTRACT

A nozzle cap of a trigger actuated pump sprayer is produced of two different materials using a bi-injection molding process for delimiting the markings on the outer faces of four walls of the cap serving as indicia relating to specific rotative positions of the cap.

6 Claims, 2 Drawing Sheets

BI-INJECTION TRIGGER SPRAYER NOZZLE CAP

BACKGROUND OF THE INVENTION

This invention relates to a nozzle cap for a trigger actuated pump sprayer, and more particularly to such a nozzle cap bi-injected of two different materials for enhancing and highlighting information and indicia provided on the cap to inform the operator of a specific rotative cap position, and for establishing an anti-slip finger grip in operation.

Trigger actuated pump sprayers are well-known as typically mounted to containers of chemical cleaner or the like for household use. The trigger sprayer is normally grasped by the operator and is actuated by pulling on the trigger lever for reciprocating the pump piston to discharge the liquid product from a pump chamber through a discharge passage and discharge orifice onto the target. The discharge orifice is typically formed in a nozzle cap mounted at the nozzle end of the discharge passage for rotation about the central axis of the cap. The nozzle cap may be snap mounted in place for manual rotation without axial movement between on and off positions, the cap comprising first and second pairs of flat outer surfaces together defining a rectangular nozzle cap body in cross-section. Spin mechanics within the pump body at the nozzle end are designed such that, in two opposed rotative positions of the cap, the discharge is placed in an off position, and in two opposed rotative other positions of the cap, the discharge is placed in one of two ON positions. The ON positions are typically STREAM and SPRAY. U.S. Pat. No. 4,706,888, commonly owned herewith, discloses such spin mechanics in cooperation with the nozzle cap as aforedescribed, and is incorporated herein by reference.

The flat outer surfaces of the walls of the cap are typically provided with indicia such as OFF on the first pair of opposed walls, and such as STREAM and SPRAY on a second pair of opposed walls, to identify the two OFF and the two ON rotative positions of the cap. Such indicia may be provided during the injection molding of the cap such that the markings OFF, STREAM, SPRAY are formed using the same thermoplastic material as the remainder of nozzle cap but are slightly raised from the outer surface of each flat wall of the cap. The indicia is thus formed as a relief on each of the four flat surfaces of the cap to highlight the indicia for the benefit of the operator.

The advantage of such a prior technique in nozzle cap production is low cost in that the indicia are formed in a single contemporaneous step during the molding operation. The prior art nozzle cap is, however, disadvantaged in that indicia or the lettering on the flat side walls of the cap are of the same thermoplastic material as the remainder of the cap and therefore cannot be contrasting to enhance visibility of the indicia.

Moreover, the thermoplastic material from which the indicia is formed is typically slippery when handled with wet hands which often occurs during use of the trigger sprayer and, because of the relatively small size of the nozzle cap for especially users having large hands, it becomes difficult for the user to securely grip the cap when holding an opposing pair of side walls to effect cap rotation.

The indicia referenced above such as OFF, SPRAY, STREAM are often-times replaced by indicia in the form of international symbols such as X for OFF, dots or the like forming a narrow cone to indicate a STREAM and dots or the like forming a wide cone to indicate a SPRAY. Or, a foreign language or symbol may be provided as indicia applied to the nozzle cap of a trigger sprayer. Also, it is known to provide the indicia to the nozzle cap by stamping or otherwise applying the indicia to a flat smooth outer surface of each wall of the cap wherein the stamped indicia may be applied in a color which contrasts from that of the cap itself. The stamping is typically not raised above the flat smooth surface of the wall of the cap, but since it is contrasting, it provides a clear indication of the rotative position of the cap for the user. Nevertheless, such an approach is disadvantaged in that the cap requires a two-step process for its manufacture, which only adds to the cost of production in time and materials.

It would be desirable to improve upon the nozzle cap to enhance the grippability of the walls of the cap and to improve upon the visibility of the indicia, in such a manner as to preserve low cost at high production speeds.

SUMMARY OF THE INVENTION

It is an object of the present invention to improve upon the manually rotatable nozzle cap of trigger actuated pump sprayers to render the sprayer easier to use and handle when manipulating the nozzle cap between its ON and OFF positions. The relief impressions applied to the outer faces of the flat walls of the nozzle cap bearing indicia relating to ON and OFF positions of the cap, are to be improved upon to render the indicia more visible and more tactile in feel, resulting in anti-slippage when handled if wet and improving upon the gripping action of the nozzle cap for rotating it between its ON and OFF positions. This objective is to be achieved utilizing a one-step operation in the production of the nozzle permitting high production speeds at low cost.

In carrying this general objective, the nozzle cap according to the invention is produced utilizing a known bi-injected technique of multimaterial injection molding in which a blank is molded from a first thermoplastic material whereafter it is permitted to cool to assure that it may function as mold whereafter a further thermoplastic material is co-injected into the mold formed by the first material such that the two materials are firmly welded together.

Further according to the invention, the second thermoplastic material may be of a different color and/or more elastic than the first thermoplastic material, so as improve upon the nozzle cap to enhance the indicia to render it more recognizable and/or less prone to slippage.

The second thermoplastic material co-injected to form the indicia may be raised from the outer surface of the flat wall of the nozzle cap in which it is formed to enhance both the tactile feel and to increase the anti-slippage characteristic of the cap.

Other objects, advantages, and novel features of the invention will become more apparent from the following detailed description of the invention when taken in conjunction with the accompanying drawings.

DETAILED DESCRIPTION OF THE INVENTION

Figure 1:
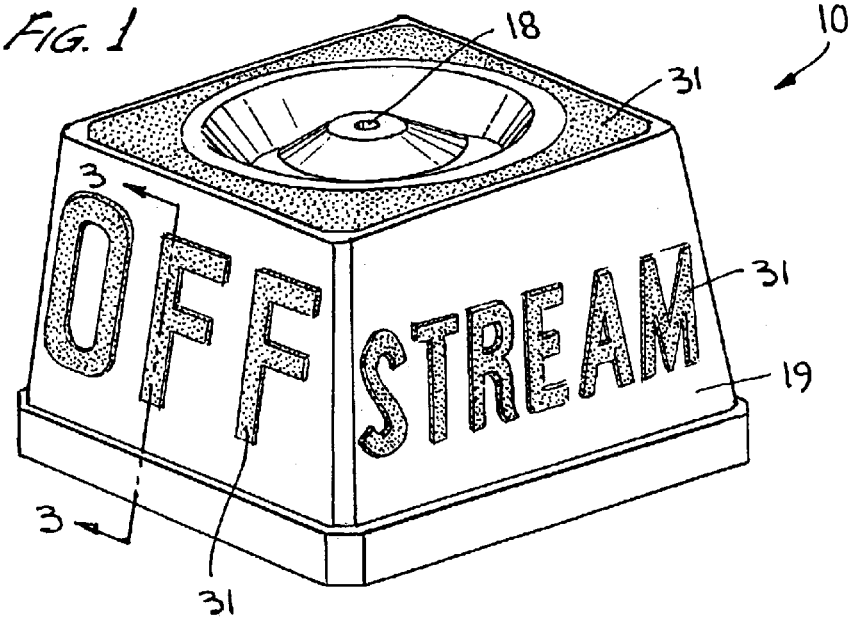
FIG. 1 is a perspective view of a nozzle cap for a trigger operated pump sprayer structured in accordance with the invention.
Figure 2:
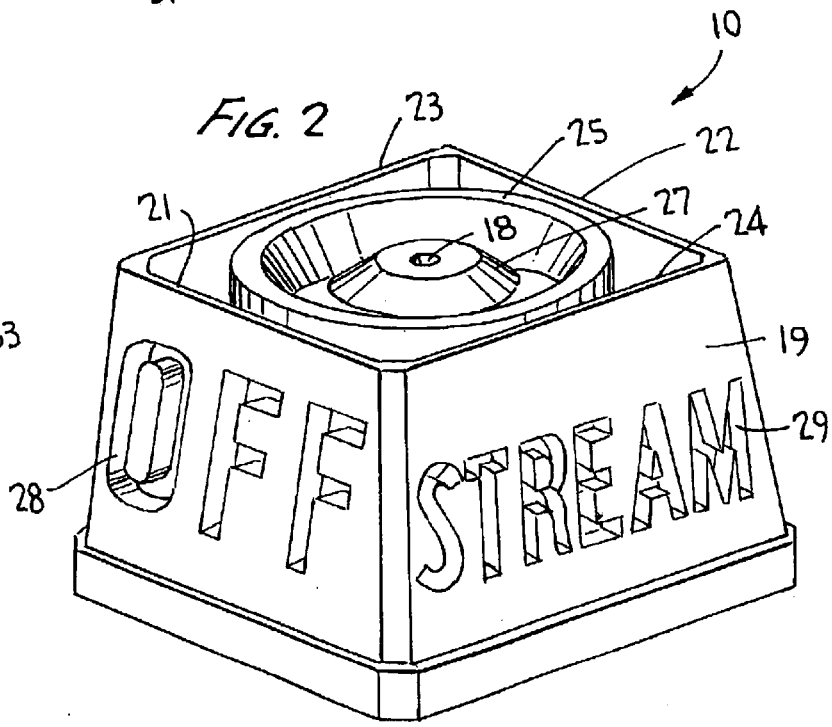
FIG. 2 is a view similar to FIG. 1 of the nozzle cap formed of the first thermoplastic material before the second thermoplastic material is co-injected therewith.
Figure 4:
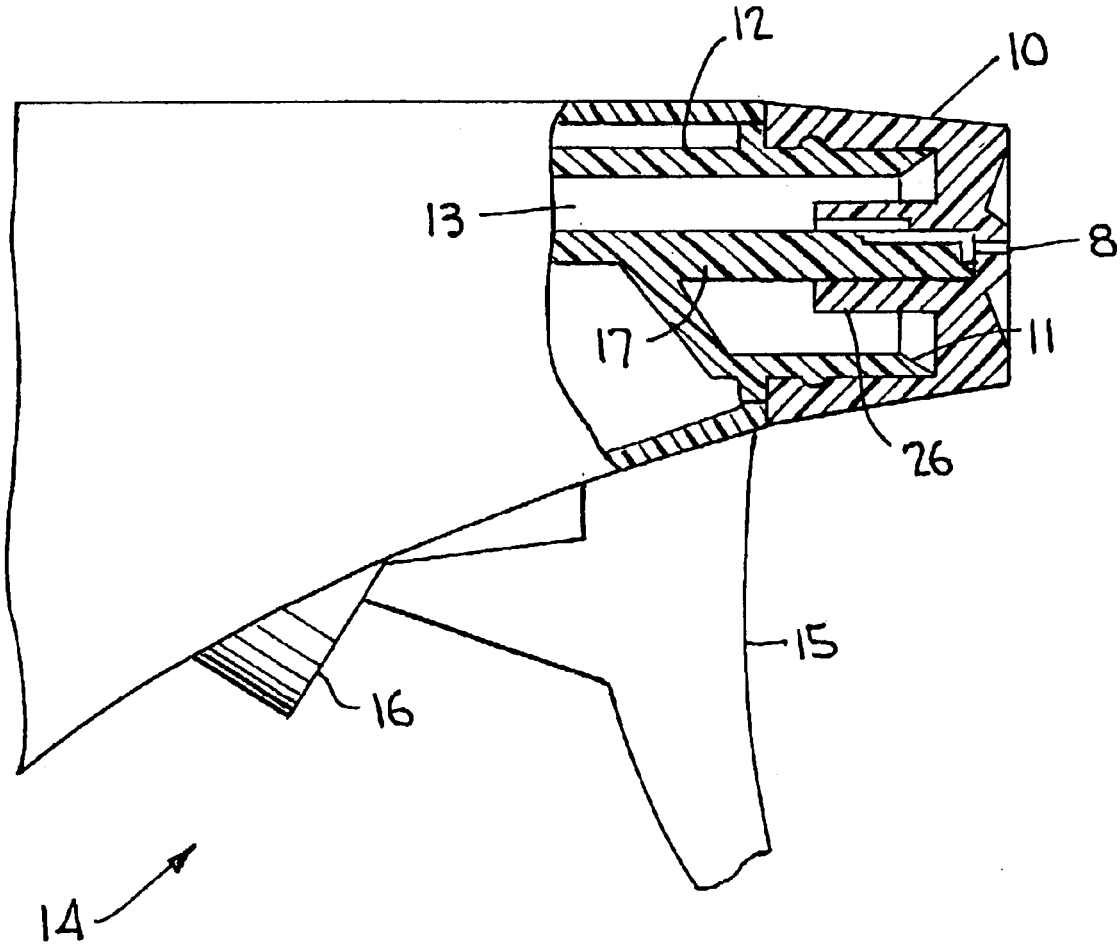
FIG. 4 is a side elevational view of a part of a trigger operated sprayer which includes a nozzle cap structured as in FIG. 1 of the invention.

Turning now to the drawings wherein like reference characters refer to like and corresponding parts throughout the several views, nozzle cap 10 structured and produced according to the invention is shown in detail in FIG. 1 and is shown in FIG. 4 snap-fit mounted in place on a nozzle 11 at the end of a discharge barrel 12 defining a discharge passage 13 of a known trigger actuated pump sprayer generally designated 14. The sprayer has a trigger lever 15 mounted to the pump body for actuating a pump piston (not shown) within pump cylinder 16. Nozzle cap 10 has spin mechanics cooperating with the end of plug 17 for turning off and opening the discharge upon manual rotation of the cap. Such spin mechanics is well known and forms no part of the invention and is disclosed in detailed in U.S. Pat No. 4,706,888, commonly owned herewith. And, nozzle cap 10 is formed with a discharge orifice 18 in communication with discharge passage via the spin mechanic.

The nozzle cap comprises a body 19 injection molded of a first thermoplastic material such as polypropylene which is generally rigid after being molded. Body 19 comprises a first pair of opposed outer flat walls 21, 22, and a second pair of opposed outer flat walls 23, 24, the walls being interconnected as shown to form a body substantially rectangular in cross-section. The four walls support an inner cylinder 25 having an inner skirt 26 (FIG. 4) in engagement with plug 17. Inner cylinder 25 is closed at its front end by a wall 27 having discharge orifice 18 formed therein on the axis of the nozzle cap.

In accordance with the invention, the nozzle cap is formed by intermolding of different materials referred to as a bi-injection molding or multimaterial injection molding procedure. This procedure is disclosed in some detail in U.S. Pat. No. 5,439,124, the entirety of the disclosure of which being specifically incorporated herein by reference.

Body 19 of the cap is injection molded of a first thermoplastic material forming a blank in each outer surface of walls 21, 22, 23 and 24. The blanks shown in walls 21 and 24 are formed as indicia which, in the example shown, are OFF and STREAM. Although not seen in the drawings, wall 23 would have a blank in the form of indicia noting the position SPRAY and the outer surface of wall 22 would be formed with a blank of indicia in the form of the position OFF. Obviously, international indicia can be substituted for the on and off positions such a X for OFF, a narrow conical figure of dots or the like indicating STREAM, and a wider conical figure of dots or the like indicating SPRAY. Moreover, foreign language wording or symbols can be applied as appropriate.

Figure 3:
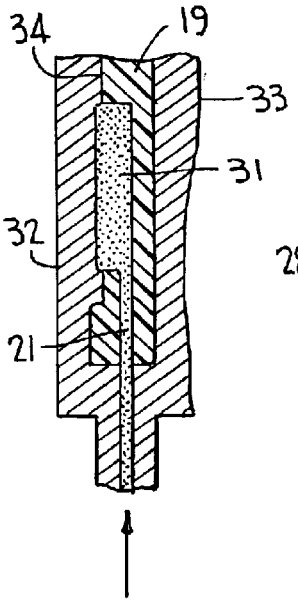
FIG. 3 is a cross-sectional view taken substantially along the line 3—3 of FIG. 1 showing the manner of co-injecting the first and second thermoplastic materials in the process of producing the FIG. 1 cap.

Blank 28 forming the letters OFF in the outer face of wall 21 of the cap will be described as part of the bi-injection process in the production of the nozzle cap according to the invention, although it should be pointed out that blank 29 in the outer face of wall 24, and the blanks in the outer faces of walls 22 and 23 (not shown) all form a "blank" collectively in the production process. Thus, body 19 is molded as a blank from a first thermoplastic material with the letters OFF, STREAM, OFF and SPRAY, for example, being formed in walls 21, 24, 22 and 23 thereof. The blank is then sufficiently cooled to ensure that it is mechanically stable to serve as a mold. The mold used for molding the blank is then at least partly replaced, and the finished molding is bi-injected molded of a further or second thermoplastic material such that the blank partly serves as a mold. On cooling the two materials are firmly welded together. The second thermoplastic material may be of a different color than the first material, or the second thermoplastic material may be of an elastic material, or the second thermoplastic material may be of both a different color from the first material and of an elastic material. The second material is illustrated at 31 in FIGS. 1 and 3 which fills cavities 28 and 29 forming the lettering in the outer faces of walls 21, 22, 23 and 24. The molding platens 32, 33 for forming the blank of the first thermoplastic material, are schematically shown in FIG. 3. The first thermoplastic material may be a polypropylene molded in a cavity of a mold assembly shown schematically at 32, 33. Lettering 28 and 29 are formed by blocking a part of the cavity with a movable blocking member or the like, whereafter the blank of the first material is allowed to cool for a predetermined time. The blocking member is then removed whereupon lettering 28 and 29 are formed as cavities whereafter the second thermoplastic material 31, such as an elastic thermoplastic, is injected into the cavities which form lettering 28 and 29. After cooling the interface between the first and second thermoplastic materials are bonded by welding of melted portions thereof so as to be irreversibly interconnected.

As shown in FIGS. 1 and 3, the second material 31 when bi-injection molded into cavities 28 and 29, fills the cavities formed by the letterings shown and may be flush with the outer surface of the wall of the blank in which it is formed, or may extend slightly beyond the wall of the surface in which it is formed as, for example, extending slightly beyond and outwardly of outer surface 34 (FIG. 3) of wall 21 of the nozzle cap. In either case, whether flush or protruding outwardly, the second material 31, if elastomeric, provides for tactile sensing by the operator which is softer to the touch, and provides an anti-skid surface when contacted by the operator to substantially prevent slippage of the operator's fingers from the nozzle cap upon rotation especially when the fingers or the nozzle cap is wet. With material 31, when elastomeric, protruding outwardly from outer surface 34 of its wall, for example, the material is even more tactile and softer to the touch and has an even greater anti-skid characteristic.

If the second material 31 is different from the first material forming body 19 only by color, there is a little, if any, anti-skid characteristic offered except that the contrasting color between the indicia and the main body of the cap provides an improvement in that the indicia clearly stands out for recognition even in darkened areas of use. The advantage in bi-injection in the production of the nozzle cap according to the invention in such instance is that both the first and second materials are applied in an essentially single step operation without having the cap completely cool and thereafter be forwarded to a stamping station where the outer walls are stamped with indicia, as in the prior art.

Obviously, many other modifications and variations of the present invention are made possible in the light of the above teachings. It is therefore to be understood that within the scope of the appended claims, the invention may be practiced otherwise than as specifically described.

What is claimed is:

1. A trigger actuated pump sprayer comprising, a pump body having a discharge passage terminating in a nozzle at a forward end of the sprayer, a nozzle cap mounted on said nozzle for rotation between on an off positions about a central axis of said cap, the cap having a discharge orifice lying on said central axis, and the cap having a first pair of opposing flat side walls and a second pair of opposing flat side walls together defining a rectangular body, at least one of said side walls having a marking indicating a selected rotation of the cap relative to the nozzle, the nozzle cap including a body structure comprising a first rigid portion of molded material defining each of said side walls and a discharge passage terminating in the discharge orifice, the marking of said one of said walls being defined by a recessed area forming a mold blank, and the nozzle cap further including a second portion of molded material bi-injected with the first material into the mold blank so as to be welded together at an interface of the first and second portions.

2. The pump sprayer according to claim 1, wherein the second portion of molded material projects outwardly beyond an outer surface of one of the side walls.

3. The pump dispenser according to claim 1, wherein each of said side walls has a marking indicating selective rotative positions of the cap relative to the nozzle, each said marking being defined by a recessed area forming a mold blank in each of said side walls, the second portion of molded material being bi-injected into each said mold blank so as to be welded together at the interface of the first and second portions.

4. The pump dispenser according to claim 3, wherein the second portion of molded material in each of said blanks projects outwardly beyond an outer surface of the side walls respectively.

5. The pump dispenser according to claim 2, wherein the first portion of molded material comprises a thermoplastic material, and the second portion of molded material comprises an elastomeric thermoplastic material to define an anti-slip grip by fingers of an operator of the sprayer.

6. The pump dispenser according to claim 4, wherein the first portion of molded material comprises a thermoplastic material, and the second portion of molded material comprises an elastomeric thermoplastic material to define an anti-slip grip by fingers of an operator of the sprayer.

* * * * *